US012343607B2

(12) United States Patent
Poirier et al.

(10) Patent No.: US 12,343,607 B2
(45) Date of Patent: Jul. 1, 2025

(54) GOLF BAG WITH TOP CUFF

(71) Applicant: Acushnet Company, Fairhaven, MA (US)

(72) Inventors: Brian R. Poirier, Portsmouth, RI (US); Paul Robinson, Plainville, MA (US)

(73) Assignee: Acushnet Company, Fairhaven, MA (US)

( * ) Notice: Subject to any disclaimer, the term of this patent is extended or adjusted under 35 U.S.C. 154(b) by 43 days.

(21) Appl. No.: 18/131,947

(22) Filed: Apr. 7, 2023

(65) Prior Publication Data

US 2024/0335713 A1 Oct. 10, 2024

(51) Int. Cl.
*A63B 55/40* (2015.01)

(52) U.S. Cl.
CPC ..... *A63B 55/40* (2015.10)

(58) Field of Classification Search
CPC ..... A63B 55/40
USPC ..... 206/315.2, 315.3, 315.47, 315.5, 315.6, 206/315.7, 315.8
See application file for complete search history.

(56) References Cited

U.S. PATENT DOCUMENTS 2,435,479 A * 2/1948 Thommen ..... A63B 55/00 220/9.2
4,266,589 A * 5/1981 Cochran ..... A63B 55/50 206/315.3
4,378,039 A * 3/1983 Suk ..... A63B 55/00 206/315.8
4,691,823 A * 9/1987 Pape ..... A63B 55/40 206/315.6
5,482,160 A * 1/1996 Perrin ..... A63B 55/40 135/125
5,638,954 A * 6/1997 Hsien ..... A63B 55/00 206/315.3
5,769,220 A * 6/1998 Hong ..... A63B 55/00 206/315.3
5,788,071 A * 8/1998 Shiao ..... A63B 55/00 206/315.3
5,918,737 A * 7/1999 Kwon ..... A63B 55/40 206/315.6
5,941,383 A * 8/1999 Cheng ..... A63B 55/00 206/315.3
5,984,095 A * 11/1999 Kim ..... A63B 55/40 206/315.6
6,047,822 A * 4/2000 Batten ..... A63B 55/40 206/315.6

(Continued)

FOREIGN PATENT DOCUMENTS

CN 112791362 5/2021
CN 107115645 7/2022

(Continued)

*Primary Examiner* — Ernesto A Grano

(57) ABSTRACT

A golf bag comprising a body with an opening, a closed bottom, and one or more body panels; a top cuff attached to the opening, the top cuff comprising a first member extending along one or more sides of the top cuff and a second member extending above or below the first member; and a lining configured to extend around or over the first member of the top cuff. The lining may be secured to an inner surface of the top cuff. The one or more body panels may be configured to extend around or over the second member of the top cuff and directly couple to a portion of the lining secured to the inner surface of the top cuff.

20 Claims, 13 Drawing Sheets

(56) References Cited

U.S. PATENT DOCUMENTS

| | | | | |
|---|---|---|---|---|
| 6,510,944 | B2 * | 1/2003 | Chang | A63B 55/00 206/315.6 |
| 6,598,743 | B1 * | 7/2003 | Puskaric | A63B 55/408 206/315.6 |
| 6,935,496 | B2 * | 8/2005 | Chang | A63B 55/00 206/315.6 |
| 7,090,075 | B1 * | 8/2006 | Rocha | A63B 55/00 206/315.6 |
| 7,216,762 | B2 | 5/2007 | Chen | |
| 8,141,705 | B2 * | 3/2012 | Aubery | A63B 55/00 206/315.3 |
| 8,757,373 | B2 * | 6/2014 | Aubery | A63B 55/00 206/315.7 |
| 9,586,109 | B2 * | 3/2017 | Martell | A63B 55/20 |
| 9,662,553 | B2 * | 5/2017 | Cheng | A63B 55/50 |
| 9,789,373 | B2 * | 10/2017 | Cheng | A63B 55/40 |
| 10,173,112 | B2 * | 1/2019 | Martell | A63B 55/53 |
| 11,123,616 | B2 * | 9/2021 | Martell | A63B 55/57 |
| 11,911,673 | B2 * | 2/2024 | Martell | A63B 55/57 |
| 2002/0096444 | A1 * | 7/2002 | Chang | A63B 55/00 206/315.6 |
| 2006/0108243 | A1 | 5/2006 | Tan | |
| 2006/0272967 | A1 * | 12/2006 | Bremner | A63B 55/404 206/315.6 |
| 2007/0138040 | A1 * | 6/2007 | Chan | A63B 55/40 206/315.3 |
| 2011/0303568 | A1 * | 12/2011 | Reimers | A63B 55/40 206/315.6 |
| 2013/0075290 | A1 | 3/2013 | Chang | |
| 2013/0213837 | A1 * | 8/2013 | Suk | A63B 55/40 206/315.6 |
| 2014/0034528 | A1 | 2/2014 | Anderson | |
| 2016/0346652 | A1 | 12/2016 | Wang | |
| 2022/0184476 | A1 | 6/2022 | Zhang | |

FOREIGN PATENT DOCUMENTS

| | | |
|---|---|---|
| CN | 217339995 | 9/2022 |
| CN | 218129853 | 12/2022 |

* cited by examiner

GOLF BAG WITH TOP CUFF

BACKGROUND

Golf bags can be used to hold or carry golf equipment including golf clubs or balls, as well as accessories such as head covers, apparel, brushes and/or towels, umbrellas, golf tees, scorecards, writing utensils, and/or range finders. In some cases, golfers may walk a golf course and carry their golf bags. In other cases, golfers may use a push cart or a trolley. Alternatively, golfers may use a golf cart to transport their golf equipment around a golf course. In some cases, golf bags may be designed for different modes of transportation in order to accommodate the various needs and/or preferences of golfers.

SUMMARY

The present disclosure provides various examples and embodiments of golf bags comprising a top cuff with an exposed front panel. The exposed front panel may not or need not comprise any fabric or other textile material covering the front panel. The golf bags of the present disclosure may be universally compatible with golf bag holding mechanisms (e.g., a bag retention or securement mechanism that is attachable to or integrated with a golf cart or a golf push cart or trolley). The exposed front panel of the presently disclosed golf bags may extend downward from the top opening of the top cuff towards a separately provided knuckle bracket having knuckles for engaging with one or more legs. The exposed front panel may provide a support surface that is positioned to contact a golf bag holding mechanism (or any portion or component thereof). The support surface of the exposed front panel may comprise a rigid material that is wear-resistant and does not experience accelerated physical or aesthetic degradation (e.g., discoloring) like other conventional golf bags with a fabric or textile covered front panel that directly contacts portions or components of bag holding mechanisms.

The present disclosure provides additional examples and embodiments of golf bags comprising a top cuff and a separately provided knuckle bracket that is attachable to the top cuff, one or more body panels, a lining, and a front liner piece. The knuckle bracket and the corresponding knuckles may be positioned at one or more predetermined distance(s) from the closed bottom of the golf bag and/or the top cuff so that the knuckles and the legs of the bag do not directly contact a securement mechanism of a bag holding mechanism. The knuckle bracket, the knuckles, and the legs of the bag may be positioned to allow the exposed front panel to directly contact the securement member of the bag holding mechanism. The knuckle bracket, knuckles, and legs of the bag may be positioned to minimize or prevent any intervening or interfering physical interactions with the bag holding mechanism which might prevent a flush contact between the support surface of the exposed front panel and the securement mechanism of the bag holding mechanism. The positioning of the knuckle bracket, knuckles, and legs may not negatively impact or otherwise compromise (i) the stability of the legs when deployed or (ii) a retractability of the legs for transport or storage.

In one aspect, the present disclosure provides examples and embodiments of golf bags comprising (i) one or more body panels and (ii) a lining that wrap over or around the top cuff of the golf bags. In some cases, the one or more body panels may extend around or over the lining that wrap over or around the top cuff. In some cases, the one or more body panels may be secured directly to (i) the lining and/or (ii) an inner surface of the top cuff. The body panels and the lining may comprise separate components or pieces with different material properties. The golf bags disclosed herein may comprise a body panel that extends continuously from the bottom of the bag to the top of the top cuff. The body panel may be secured to the golf bag without using any externally visible fasteners since the body panels can be wrapped over the top cuff and directly affixed to an inner surface of the top cuff or a lining that is already affixed to the inner surface of the top cuff. In some cases, the body panels of the golf bag can be wrapped around or over the top cuff in tension and directly or indirectly secured to the top cuff, thereby minimizing the number of fasteners used to construct the golf bag. In some cases, the golf bags disclosed herein may be assembled using fewer fasteners compared to other conventional golf bags without compromising the structural integrity or aesthetics of the golf bag. In some cases, the golf bags of the present disclosure may be fabricated or manufactured without needing to utilize a secondary cuff panel.

In another aspect, the present disclosure provides examples and embodiments of golf bags comprising a lining and a separate front liner piece. The lining may wrap around or over the top cuff of the golf bag. In some cases, the lining may be configured to provide a protective layer or cover to minimize wear or damage to the top cuff material and/or any clubs placed in a compartment formed by the dividers of the top cuff. The separate front liner piece may interface with a slot, channel, or opening provided along an inner surface of the top cuff (e.g., by wrapping around or over a wall or an edge of the slot, channel, or opening). In some cases, the front liner piece may be configured to provide a protective layer or cover at or near a top front portion of the top cuff (e.g., to minimize wear or damage to the top cuff material and/or any clubs placed in a compartment adjacent to the top front portion of the top cuff). In some cases, the front liner piece may be configured to provide a protective layer or cover between a golfer's equipment and the top cuff material without interfering with or covering the exposed front panel of the top cuff.

In another aspect, the present disclosure provides a golf bag comprising: a body comprising an opening, a closed bottom, and one or more body panels; a top cuff attached to the opening, the top cuff comprising a first member extending along one or more sides of the top cuff and a second member extending above or below the first member; and a lining configured to extend around or over the first member of the top cuff. In some embodiments, the lining is secured to an inner surface of the top cuff. In some embodiments, the one or more body panels are configured to extend around or over the second member of the top cuff and directly couple to a portion of the lining secured to the inner surface of the top cuff.

In some embodiments, the one or more body panels are releasably coupled to the portion of the lining secured to the inner surface of the top cuff. In some embodiments, the one or more body panels overlap the portion of the lining secured to the inner surface of the top cuff. In some embodiments, the one or more body panels comprise at least one panel that extends continuously from the closed bottom to the second member of the top cuff. In some embodiments, the one or more body panels and the lining extend over or around a same portion or section of the top cuff.

In some embodiments, the top cuff comprises an exposed front panel configured to contact or interface with a bag holding mechanism. In some embodiments, the one or more body panels do not cover or overlap the exposed front panel.

In some embodiments, the first and second members extend between a front portion and a back portion of the top cuff. In some embodiments, the first member and the second member are disposed at different heights or different distances from the opening of the body. In some embodiments, the top cuff further comprises one or more apertures, windows, or openings formed between the first member and the second member. In some cases, the lining is configured to extend through the one or more apertures, windows, or openings. In some cases, the one or more body panels are configured to extend across the one or more apertures, windows, or openings.

In some embodiments, the golf bag may further comprise a knuckle bracket configured to interface with one or more legs for supporting the golf bag. In some embodiments, the knuckle bracket and the top cuff comprise separate components that are not integrally formed.

In some embodiments, a portion of the one or more body panels is disposed between the knuckle bracket and a lower portion of the top cuff. In some embodiments, the one or more body panels do not cover or overlap the knuckle bracket or an upper portion of the top cuff. In some embodiments, the one or more body panels extend along or under an upper portion of the top cuff. In some embodiments, the upper portion of the top cuff extends further out or away from a front side of the top cuff than the lower portion of the top cuff. In some embodiments, the knuckle bracket is positioned (i) along the lower portion of the top cuff and (ii) under the upper portion of the top cuff.

In some embodiments, the golf bag may further comprise one or more fasteners for securing the lining or the one or more body panels to the top cuff. In some embodiments, the golf bag may further comprise one or more tabs for securing the lining or the one or more body panels to the top cuff. In some embodiments, the golf bag may further comprise one or more fasteners and one or more tabs for securing the lining or the one or more body panels to the top cuff.

In some embodiments, the golf bag may further comprise a channel slot extending along a portion of the inner surface of the top cuff. In some embodiments, the lining comprises one or more integrated tabs insertable into the channel slot to secure the lining to the inner surface of the top cuff.

In some embodiments, the golf bag may further comprise a front liner piece that is separate from the lining and independently securable to the top cuff. In some embodiments, the front liner piece does not cover or overlap an exposed front panel of the top cuff. In some embodiments, the exposed front panel may be configured to contact or interface with a bag holding mechanism.

In some embodiments, the front liner piece comprises one or more integrated tabs insertable into the channel slot to secure the front liner piece to the inner surface of the top cuff. In some embodiments, the front liner piece comprises a support board and a foam material. In some embodiments, the front liner piece is configured to wrap over onto itself. In some embodiments, a first portion of the front liner piece is attachable to a second portion of the front liner piece. In some embodiments, the front liner piece and/or the one or more body panels comprise one or more integrated tabs that are (i) insertable into the channel slot from a bottom of the channel slot and (ii) configured to extend upwards into the channel slot from the bottom of the channel slot to secure the front liner piece and/or the one or more body panels to the top cuff.

In some embodiments, the golf bag may further comprise at least one fastener for securing the front liner piece to a front portion of the top cuff. In some embodiments, the at least one fastener is configured to secure a knuckle bracket and the one or more body panels to the front portion of the top cuff.

In some embodiments, the one or more body panels comprise (i) a first body panel and a second body panel extending along opposite sides of the top cuff and (ii) a rear body panel positioned between the first and second body panels. In some embodiments, a distance between an edge of the first body panel and an edge of the second body panel is equal to a width of a bottom portion of the rear body panel. In some embodiments, a first portion of the one or more body panels is positioned between the top cuff and a knuckle bracket of the golf bag. In some embodiments, a second portion of the one or more body panels is wrapped around the top cuff.

In some embodiments, the top cuff comprises at least one divider terminating at a channel slot disposed along the inner surface of the top cuff. In some embodiments, the top cuff comprises one or more dividers terminating directly at the inner surface of the top cuff. In some embodiments, the top cuff comprises one or more dividers extending directly to or from the inner surface of the top cuff. In some embodiments, the top cuff comprises at least one divider that does not extend directly to or from the inner surface of the top cuff. In some embodiments, the lining of the golf bag comprises a plurality of independently adjustable lining flaps configured to wrap around the top cuff and at least one divider of the top cuff.

Additional aspects and advantages of the present disclosure will become readily apparent to those skilled in this art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

BRIEF DESCRIPTION OF THE DRAWINGS

Non-limiting and non-exhaustive examples and embodiments of the present disclosure are described with reference to the following figures.

DETAILED DESCRIPTION

The present disclosure will now be described more fully in reference to the accompanying figures, in which various non-limiting embodiments are shown.

It shall be understood that when an element is referred to as being "attached," "coupled" or "connected" to another element, it can be directly attached, coupled or connected to the other element (with or without any intervening elements). In contrast, when an element is referred to as being "directly attached," directly coupled" or "directly connected" to another element, there may not or need not be any intervening elements present.

It is noted that any one or more aspects or features described with respect to one embodiment may be incorporated in various other different embodiments. That is, any embodiments and/or features of any embodiments can be combined in any way and/or in any order with any other embodiments and/or any other features of any embodiments, without limitation. Applicant reserves the right to modify any originally filed claim or file any new claim(s) accordingly, including the right to amend any originally filed claim to depend from and/or incorporate any feature of any other claim. Various non-limiting aspects and features of the present disclosure are provided in further detail in the specification set forth below.

Overview

In one aspect, the present disclosure provides various non-limiting examples and embodiments of a golf bag. In some cases, the golf bag may comprise a body. In some cases, the golf bag may comprise a top cuff attached to the body. In some cases, the golf bag may comprise a separate knuckle bracket configured to interface with the top cuff. In some cases, the golf bag may comprise one or more body panels. In some cases, the golf bag may comprise a lining and/or a separate front liner piece.

Figure 1:
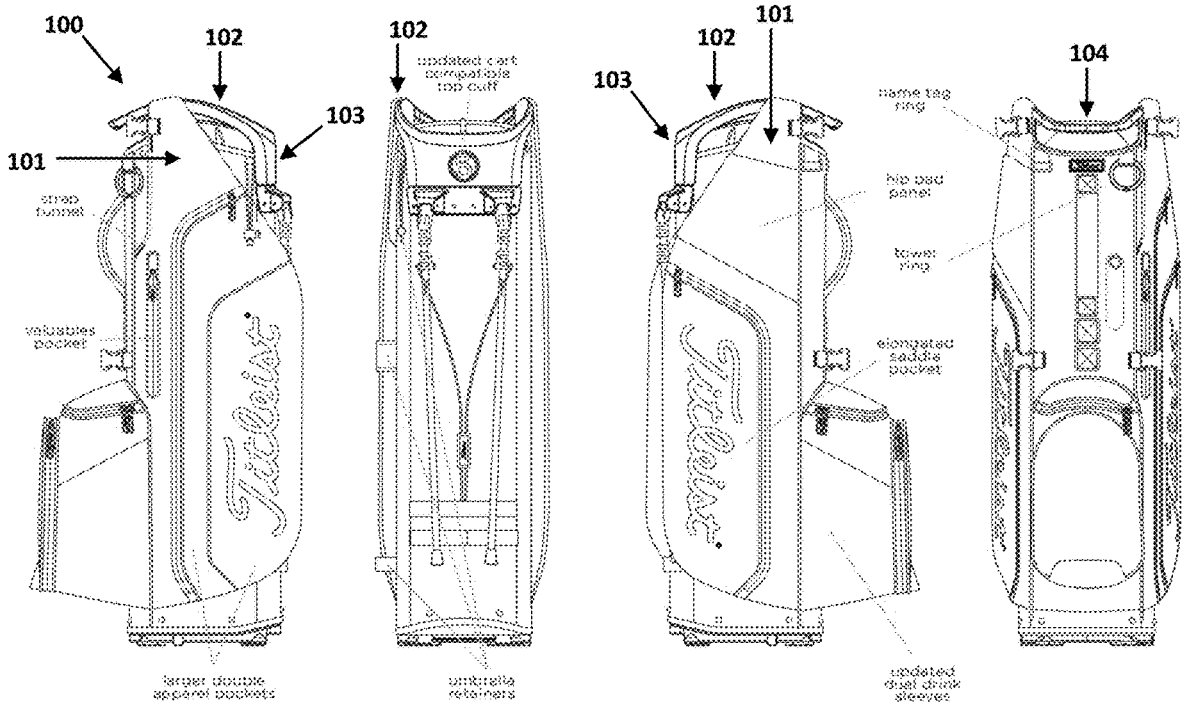
FIGS. 1 and 2 schematically illustrate an exemplary golf bag comprising a top cuff, in accordance with some embodiments.
Figure 2:
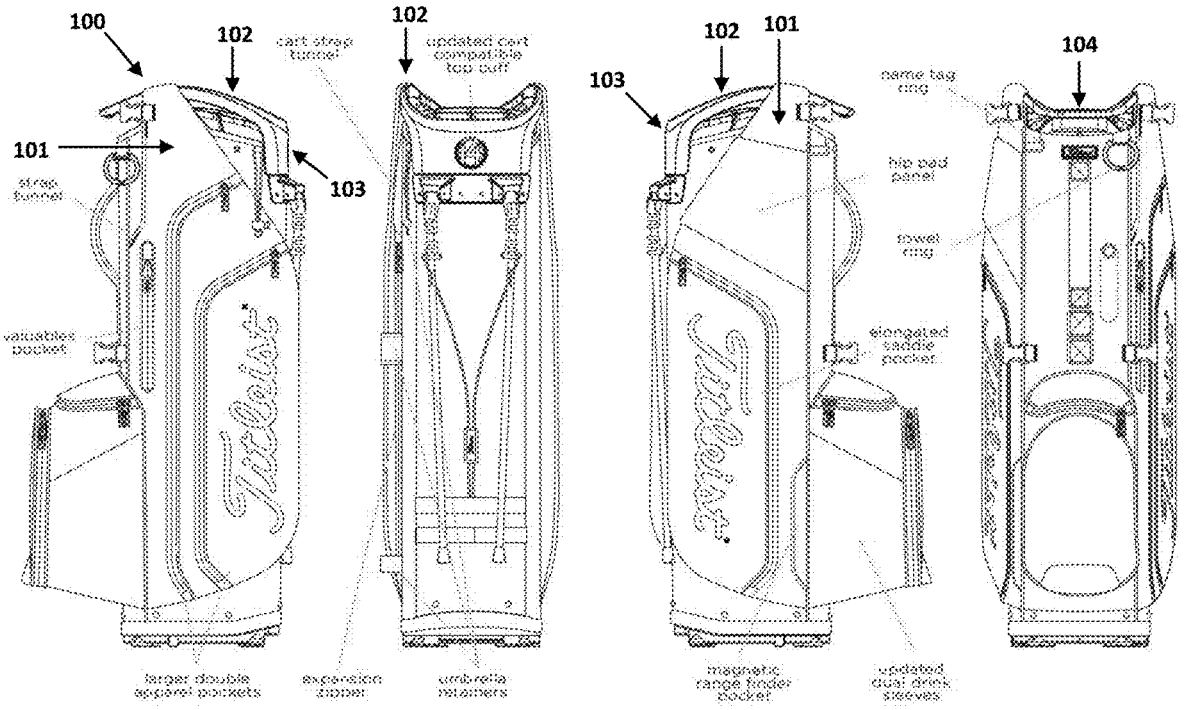

FIGS. 1 and 2 schematically illustrate an exemplary golf bag 100. The golf bag 100 may include one or more body panels 101 and a top cuff 102. The top cuff 102 may extend around the top opening of the golf bag 100. In some cases, the top cuff 102 may have a front portion 103 that includes an exposed front panel. In some cases, the top cuff 102 may have a rear portion 104 that includes an integrated handle. In some cases, the top cuff 102 may have a plurality of members that extend along the sides of the golf bag between the front portion 103 and the rear portion 104.

In some cases, the one or more body panels 101 may include one or more hip panels extending along a left and/or right side of the golf bag 100. In some cases, the one or more body panels 101 may include a front body panel extending along a front side of the golf bag 100. In some cases, the one or more body panels 101 may include a back body panel extending along a rear or back side of the golf bag 100.

In some non-limiting embodiments, the golf bag 100 may include one or more pockets. In some cases, the one or more pockets may include one or more apparel pockets or one or more valuables pockets. In some cases, the one or more pockets may include one or more storage pockets disposed on a rear portion (e.g., a back side or rear panel) of the golf bag. In some cases, the one or more pockets may include a saddle pocket. In some cases, the one or more pockets may include an additional pocket disposed adjacent to the saddle pocket. In some cases, the additional pocket may be configured to house golf-related equipment (e.g., a range finder) . In some cases, the one or more pockets may be opened and/or closed using a fastener. In some cases, the fastener may comprise a magnetic closure. In some cases, the fastener may comprise a sliding fastener. In some cases, the sliding fastener may comprise, for example, a zipper. In other cases, the fastener may comprise a snap closure (e.g., one or more buttons) or a hook and loop fastener (e.g., Velcro).

In some cases, the one or more pockets may include multiple pockets that are attached or directly adjacent to each other. In some cases, the multiple pockets may share a common wall or layer of material. In some cases, a single layer or panel may form one or more walls associated with two or more pockets. In some cases, the multiple pockets may comprise a first pocket and a second pocket. In some cases, the first pocket may be adjacent to but structurally separate from the second pocket. In other cases, the first pocket may be integrated with the second pocket. In some cases, the first pocket may be positioned inside or formed within the second pocket. In other cases, the first pocket may be provided on top of or underneath the second pocket.

In some non-limiting embodiments, the golf bag 100 may include a strap tunnel. The strap tunnel may comprise a channel or a passageway that extends (i) through a portion of the golf bag body or (ii) between two or more layers or components of the golf bag. In some cases, the strap tunnel may be configured to receive a strap for securing the golf bag 100 to a bag holding or retention mechanism. In some cases, the strap tunnel may be accessible via one or more openings located at an entrance or an exit of the channel or passageway. In some cases, the one or more openings may be sized and/or shaped to receive the strap and route the strap into the channel or passageway, through the channel or passageway, or out of the channel or passageway.

In some non-limiting embodiments, the golf bag 100 may include one or more grommets. The grommets may be placed at or near the one or more openings of the strap tunnel. In some cases, the grommets may comprise a piece of material that can line or cover the one or more openings. In some cases, the piece of material may comprise a ring or a strip of material that can line or cover the edges of the one or more openings. In some cases, the grommets may be configured to protect and/or reinforce (i) the openings of the strap tunnel and/or (ii) the material surrounding the openings (i.e., the surrounding material that is cut or pierced in order to form the one or more openings). In some cases, the grommets may be used to prevent tearing or abrasion of the pierced or cut material (e.g., due to friction or abrasion when a strap moves through the one or more openings of the strap tunnel). In some cases, the grommets may be configured to cover one or more sharp edges around the openings to prevent the strap from snagging the one or more sharp edges, and to generally protect the edges from accelerated wear and tear.

In some non-limiting embodiments, the one or more grommets may comprise a compliant or elastic material. In other non-limiting embodiments, the one or more grommets may comprise a rigid or generally inelastic or inextensible material. In some cases, the one or more grommets may comprise a rubber material. In other cases, the one or more grommets may comprise a metal material, an intermetallic material, a composite material, or a plastic material.

In some non-limiting embodiments, the golf bag 100 may include one or more umbrella retainers. The one or more umbrella retainers may be sized and shaped to accommodate one or more umbrellas. The one or more umbrellas may be in a folded configuration and/or a deployed configuration.

In some non-limiting embodiments, the golf bag 100 may include one or more drink sleeves. The one or more drink sleeves may be sized and shaped to accommodate one or more containers containing a consumable. The consumable may be a solid or a liquid substance. In some cases, the one or more drink sleeves may be configured to fix a position and/or an orientation of the one or more containers (e.g., to reduce or minimize movement of the containers and/or to prevent the consumable from spilling or leaking out of the containers).

In some non-limiting embodiments, the golf bag 100 may include one or more rings. In some cases, the one or more rings may include an accessories ring for attaching one or more golf accessories (e.g., a towel or a brush for a golf club). In some cases, the one or more rings may include a name tag ring for affixing a name tag to a portion of the golf bag 100.

Structure

Bag Body

In some embodiments, the golf bag may comprise a body. In some cases, the body may be elongated to accommodate a length of one or more golf clubs or other golf-related equipment. In some cases, the body may include an opening and a closed bottom. The opening may be located at the top of the golf bag body. The opening may be configured to receive the one or more golf clubs. The closed bottom may be configured to support the one or more golf clubs inserted into the body through the opening.

Top Cuff

In some embodiments, the golf bag may comprise a top cuff. In some cases, the top cuff may be attached to the top opening of the golf bag body.

Figure 3A:
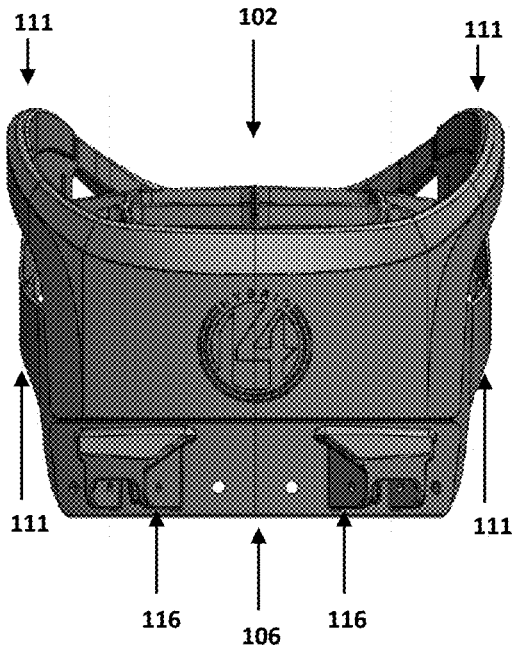
FIGS. 3A and 3B illustrate an exemplary top cuff for a golf bag, in accordance with some embodiments.
Figure 3B:
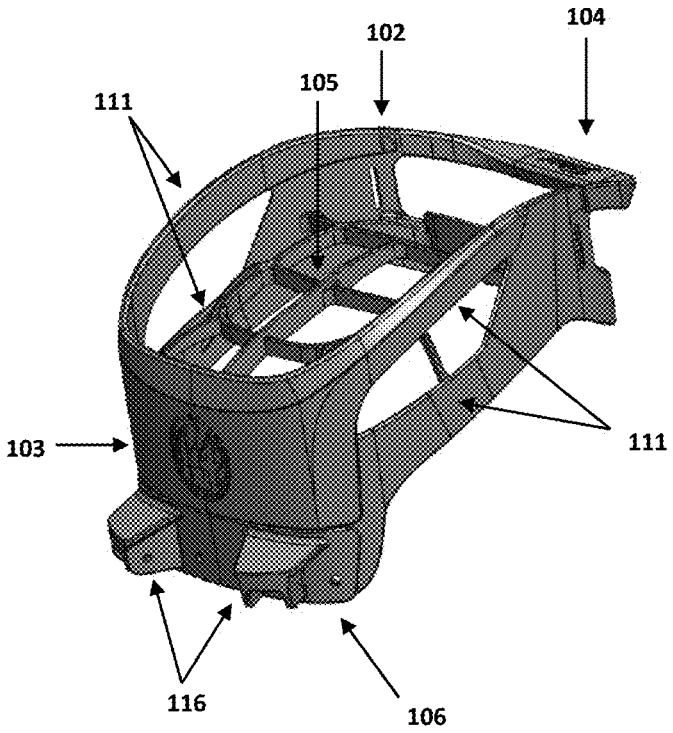

FIGS. 3A and 3B illustrate an example of a top cuff 102 of a golf bag. FIG. 3A shows a front view of the top cuff 102 of the golf bag. FIG. 3B shows a side perspective view of the top cuff 102 of the golf bag. The top cuff 102 may comprise a plurality of dividers 105 that extend across the top opening of the golf bag to form one or more compartments for receiving one or more golf clubs or other golf-related equipment.

In some cases, the top cuff 102 may have a front portion 103 comprising an exposed front panel. The exposed front panel may be positioned above a knuckle bracket 106 that is attachable to the front portion 103 of the top cuff 102. In some cases, the top cuff 102 may have a rear portion 104 comprising an integrated handle. The top cuff 102 may comprise one or more members 111 that extend along the sides of the top cuff 102 between the front portion 103 and the rear portion 104 of the top cuff 102.

In some embodiments, the top cuff may comprise an integrated handle. In some cases, the integrated handle may be provided at a rear portion 104 of the top cuff. In some cases, a front portion 103 of the top cuff may comprise an exposed panel configured to interface with or contact a bag holding mechanism.

In some cases, the front portion 103 of the top cuff may comprise an upper portion and a lower portion. In some cases, the upper portion may be configured to extend further out or away from the one or more members 111 than the lower portion of the top cuff. In some cases, the lower portion may be recessed or depressed relative to the upper portion in order to accommodate a separately provided knuckle bracket (described in greater detail below).

Figure 4A:
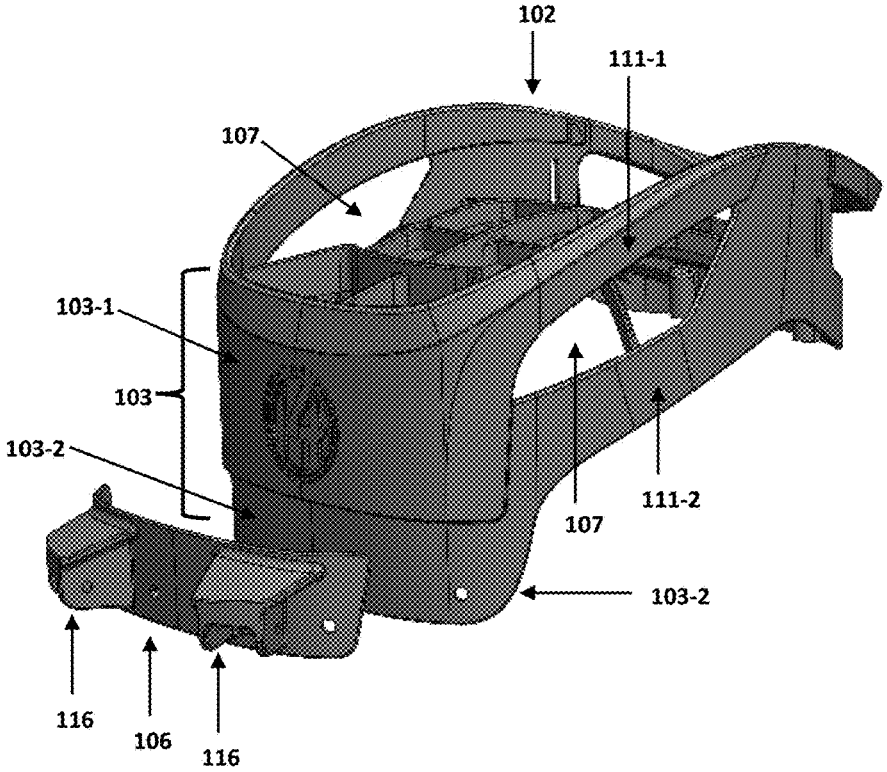
FIGS. 4A and 4B illustrate a top cuff and a knuckle bracket for a golf bag, in accordance with some embodiments.

FIG. 4A schematically illustrates a top cuff 102 comprising a front portion 103 with an upper front portion 103-1 and a lower front portion 103-2. The upper front portion 103-1 may correspond to the exposed front panel of the golf bag. The lower front portion 103-2 may correspond to a portion of the front panel that is configured to interface with a separately provided knuckle bracket 106. The lower front portion 103-2 may be sized and shaped to accommodate the size, shape, and curvature of the knuckle bracket 106.

In some embodiments, the lining, the separate front liner piece, and/or the one or more body panels of the golf bag may not or need not extend around or over a front upper portion of the top cuff. In some embodiments, the lining, the separate front liner piece, and/or the one or more body panels do not extend around or over the front upper portion of the top cuff. In some embodiments, the front upper portion may be positioned above a knuckle bracket of the golf bag. In some cases, the front upper portion may be configured to directly contact a component of a bag holding mechanism or a portion thereof. In some cases, the knuckle bracket may be positioned under the region of contact between the exposed front panel and the bag holding mechanism to avoid interfering between the exposed front panel and the bag holding mechanism, so that the exposed front panel of the golf bag can rest flush against the bag holding mechanism.

In some embodiments, the top cuff may comprise one or more members extending between the integrated handle and the exposed front panel. In some cases, the top cuff may comprise a first member 111-1 that the one or more body panels extend around or over. In some cases, the top cuff may comprise a second member 111-2 that the lining extends around or over. In some cases, the first member 111-1 and the second member 111-2 may extend along the sides of the top cuff (e.g., between the exposed front panel and the integrated handle). In some cases, the first and second members may be configured to extend between a front portion and a rear portion of the top cuff. In some cases, the first member 111-1 may correspond to an upper member of the top cuff that forms an uppermost part of the golf bag. In some cases, the second member 111-2 may correspond to a lower member of the top cuff. In some cases, the lower member may extend under or may be positioned below the upper member. In some cases, the upper member may extend over or may be positioned above the lower member.

In some embodiments, the lining for the top cuff may extend around or over the lower member. In other non-limiting embodiments, the lining may extend around or over the upper member. In some alternative embodiments, the lining may extend around or over the lower member and/or the upper member.

In some embodiments, the one or more body panels of the golf bag may extend around or over the upper member. In other embodiments, the one or more body panels may extend around or over the lower member. In some alternative embodiments, the one or more body panels may extend around or over the upper member and/or the lower member.

In some embodiments, the top cuff may comprise a plurality of members extending between the front and rear portions of the top cuff. The plurality of members may extend along the sides of the top cuff. In some cases, the plurality of members may comprise a first member 111-1 and a second member 111-2. In some cases, the first and second members may be disposed at different heights relative to each other, or at different distances from the top opening of the bag.

In some cases, the first and second members may be configured to converge at or near the front or rear portions of the top cuff (e.g., at the exposed front panel at the front of the top cuff, or at the integrated handle at the rear of the top cuff). In some cases, the first and second members may be configured to diverge along the side portion(s) of the top cuff. In some cases, the first and second members may diverge to form one or more aperture, windows, or openings 107 along the side portion(s) of the top cuff. In some embodiments, the top cuff 102 may comprise one or more apertures, windows, or openings 107. In some cases, the one or more apertures, windows, or openings 107 may be disposed between a first member 111-1 and a second member 111-2 of the top cuff 102.

In some cases, a lining of the golf bag may be configured to extend through the one or more apertures, windows, or openings 107. In other cases, a portion or section of the one or more body panels may be configured to extend through the one or more apertures, windows, or openings 107. In some cases, the lining and/or the one or more body panels may be configured to wrap over or around the first member 111-1 and/or the second member 111-2.

In some cases, the one or more body panels may be configured to extend across the one or more apertures, windows, or openings 107 without passing through the apertures, windows, or openings 107. In some cases, the one or more body panels may be configured to extend across the one or more apertures, windows, or openings 107 without passing between the first member and the second member. In some cases, the one or more body panels may be configured to extend above and/or below the one or more apertures, windows, or openings 107 (e.g., to wrap around or over the first and/or second members).

Figure 4B:
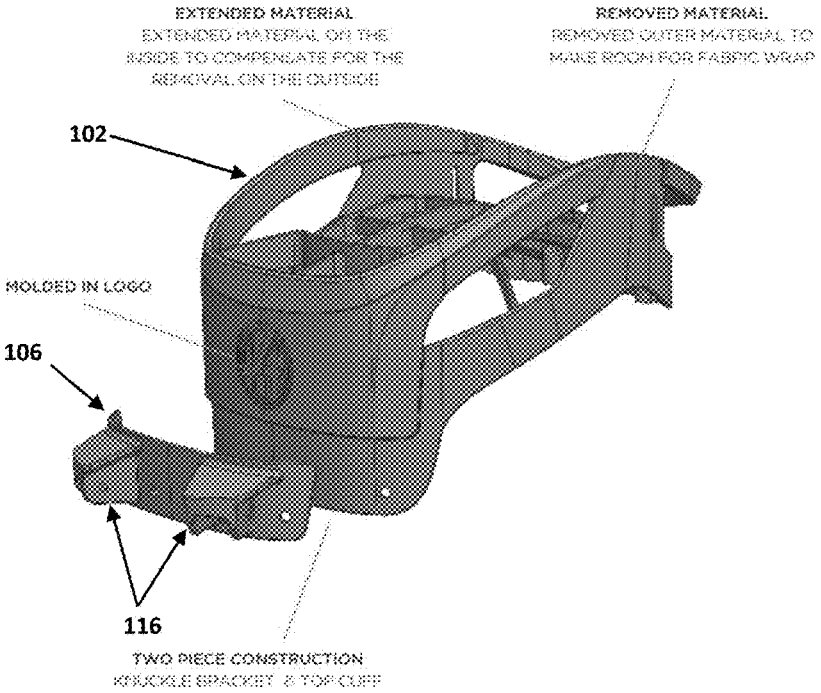

FIG. 4B illustrates another exemplary top cuff 102 according to embodiments of the present disclosure. In some cases, a select outer portion of the top cuff 102 may be recessed (e.g., by removing material from the select outer portion of the top cuff) to accommodate one or more body panel sections or segments extending along or over the outer surfaces of the top cuff 102 before wrapping around or over the top cuff 102. In some cases, the top cuff 102 may comprise additional material provided along a select inner portion of the top cuff to stiffen the top cuff. In some cases, the select inner portion may be opposite the select outer portion. The enhanced structural support provided by the additional material in the select inner portion may compensate for or offset any change in structural support due to the removal of material in the select outer portion to accommodate the body panel sections or segments.

In some cases, the top cuff may comprise a plurality of dividers configured to define one or more compartments for receiving the one or more golf clubs and/or various golf-related equipment. The plurality of dividers may be configured to extend across the top opening of the golf bag body. In some cases, the plurality of dividers may comprise a rigid material. In other cases, the plurality of dividers may comprise an extensible or elastic material.

Lining

Referring to FIGS. 5, 6A-6B, 9, 10, and 12A-12E, in some embodiments, the golf bag may comprise a lining 201. In some embodiments, the lining 201 may comprise a foam material. In some cases, the lining 201 may be configured to extend around or over the top cuff. In some cases, the portion of the lining 201 extending around or over the top cuff may be secured to an inner surface of the top cuff.

In some embodiments, the lining 201 may be configured to cover or wrap at least a portion of the top cuff 102. In some cases, the lining 201 may be configured to cover or wrap one or more select portions of the top cuff 102. In some cases, the one or more select portions may include the sides of the top cuff 102 under the apertures, windows, or openings disposed between the members of the top cuff 102. In some cases, the one or more select portions may include a rear lower portion of the top cuff 102. In some cases, the rear lower portion of the top cuff 102 may comprise a member extending under the integrated handle.

In some embodiments, the lining 201 may comprise a plurality of independently adjustable lining flaps. The independently adjustable lining flaps may be separated by a gap or a slit and separately attachable to different portions of the inner surface of the top cuff 102. In some cases, the independently adjustable lining flaps may be configured to wrap around the top cuff 102 and at least one of the plurality of dividers. In some cases, the independently adjustable lining flaps may include two or more lining flaps that can wrap around the sides or edges of the plurality of dividers.

Body Panels

As shown in FIGS. 1, 2, 5, and 6A-6B, in some cases, the body of the golf bag may comprise one or more body panels 101. In some embodiments, the one or more body panels 101 may comprise a fabric or a textile material. In some cases, the fabric or a textile material may be waterproof or water-resistant.

In some cases, the one or more body panels 101 may extend between the opening and the closed bottom of the bag. In some cases, the one or more body panels 101 may comprise at least one panel that extends continuously from the closed bottom to the top cuff of the golf bag.

In some cases, the body panels 101 may extend around a central region to form an enclosed or partially enclosed interior region for housing one or more golf clubs and/or other golf-related equipment. In some cases, the body panels 101 may extend around the one or more golf clubs to form the body of the golf bag. In some cases, the body panels 101 may extend around a frame structure or a support structure of the golf bag to form the body of the golf bag.

In some embodiments, the one or more body panels 101 may be configured to extend around or over the top cuff 102. In some embodiments, the portion(s) of the body panels 101 extending around or over the top cuff 102 may be directly coupled to the portion(s) of the lining secured to the inner surface of the top cuff 102.

In some cases, the portion of the body panels 101 extending around or over the top cuff 102 can be releasably coupled to the portion(s) of the lining secured to the inner surface of the top cuff 102. In some cases, one or more hook and loop fasteners may be used to detachably couple the body panels 101 to the portion(s) of the lining secured to the inner surface of the top cuff 102.

In some embodiments, the one or more body panels 101 may be configured to overlap the portion(s) of the lining that are secured to the inner surface of the top cuff 102. In some embodiments, the body panels 101 may overlap the lining such that the lining is positioned between the body panels 101 and the inner surface of the top cuff 102.

In some embodiments, a first portion of the one or more body panels 101 may be positioned around the front portion of the golf bag, between the top cuff 102 and a knuckle bracket 106 of the golf bag. In some embodiments, a second portion of the one or more body panels 101 may extend along a side of the golf bag and wrap around the top cuff 102. In some cases, the first portion and the second portion may comprise separate and distinct panels that partially overlap or cover each other. In other cases, the first and second portions may be part of a same body panel formed of a single continuous piece of material.

In some non-limiting embodiments, the one or more body panels 101 may comprise (i) a first body panel and a second body panel extending around opposite sides of the top cuff 102 and (ii) a rear body panel. The rear body panel may extend along a back side or a rear portion of the golf bag body (e.g., the portion of the golf bag body that extends under the integrated handle formed with the top cuff). In some cases, the rear portion of the golf bag may be opposite the front portion of the golf bag where the legs of the bag are pivotably attached. In some cases, a distance between an edge of the first body panel and an edge of the second body panel may be equal to or approximately equal to a width of a bottom portion of the rear body panel of the golf bag.

Knuckle Bracket

As shown in FIGS. 3A-3B, 4A-4B, 5, and 6A-6B, in some embodiments, the golf bag may comprise a knuckle bracket 106 with knuckles 116 configured to interface with one or more legs for supporting the golf bag. In some cases, the knuckle bracket 106 and the top cuff 102 may comprise separately provided components that are not integrally formed. In some cases, the knuckle bracket 106 and the top cuff 102 may be fastened using one or more fasteners.

Figure 5:
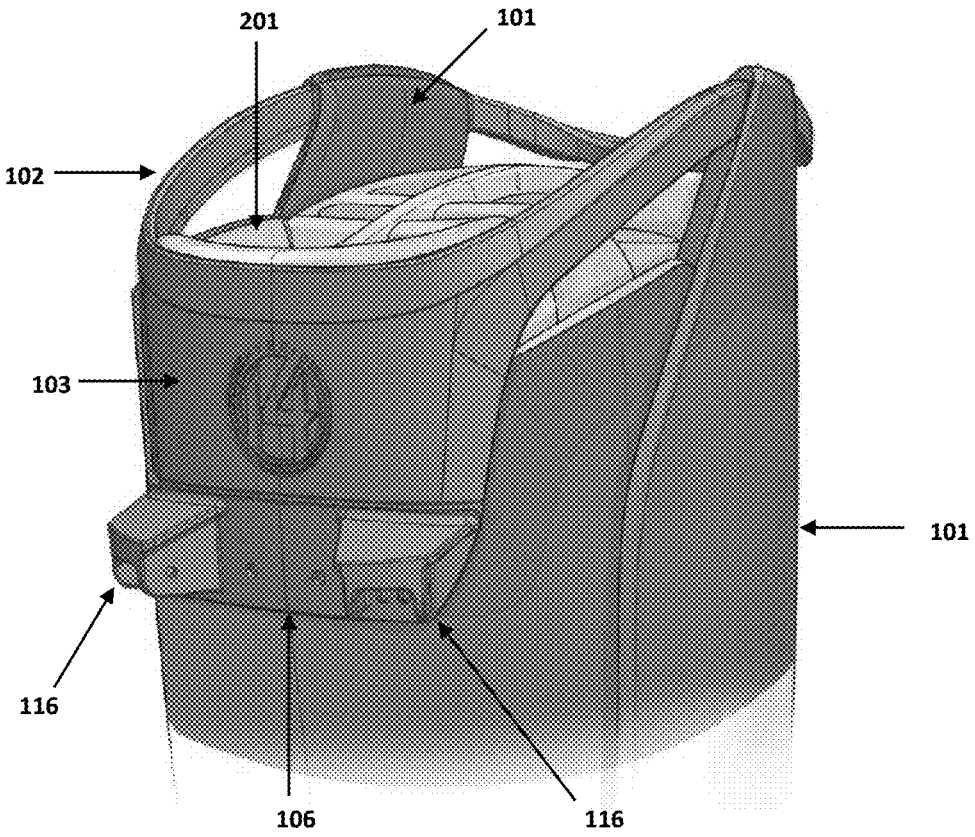
FIGS. 5 and 6A-6B illustrate an example of a golf bag with a wrapped top cuff, in accordance with some embodiments.
Figure 6A:
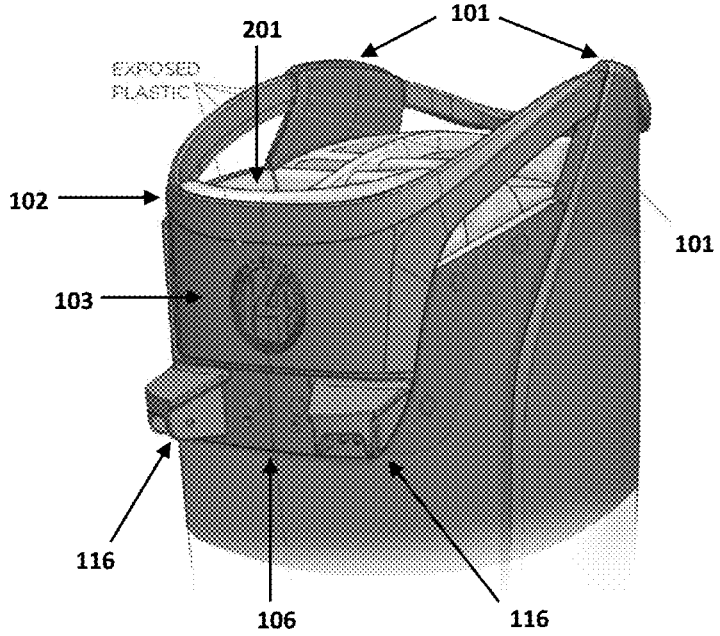
Figure 6B:
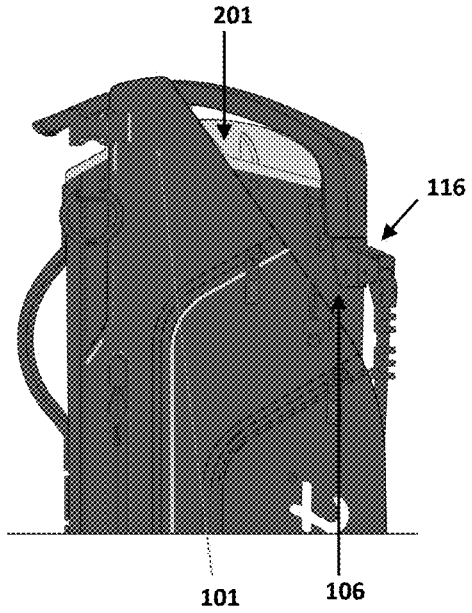

FIGS. 5 and 6A-6B illustrate an exemplary golf bag comprising a top cuff 102 and one or more body panels 101 configured to extend or wrap around a portion of the top cuff 102. FIGS. 5 and 6A illustrate a perspective view of a first side of the golf bag. FIG. 6B illustrates a side view of a second side of the golf bag. The second side of the golf bag (as shown in FIG. 6B) may be opposite the first side of the golf bag shown in FIGS. 5 and 6A. In some cases, both the first side and the second side of the golf bag may include one or more body panels 101 as described elsewhere herein. In some cases, at least a portion of the one or more body panels 101 may be configured to extend up to and wrap around or over the top cuff. The portion of the body panels 101 wrapping around or over the top cuff may be directly connected to the inner lining along an inner surface of the top cuff.

In some cases, at least one panel of the golf bag may extend around a front portion of the golf bag without covering or concealing the exposed front panel on the front portion 103 of the top cuff 102. In some cases, said at least one panel may extend around the front side of the golf bag without covering or concealing any portion of the knuckle bracket 106. The top cuff 102 may be wrapped as shown in the accompanying figures in order to expose the front panel of the top cuff 102 as well as the side and back handles of the top cuff 102.

In some embodiments, a portion of the one or more body panels 101 may be disposed between the knuckle bracket 106 and a lower (front) portion of the top cuff 102. In some embodiments described herein, the one or more body panels 101 may not or need not cover or overlap the knuckle bracket 106 or an upper portion (e.g., the exposed front panel) of the top cuff 102. In some cases, the one or more body panels 101 may extend along or under the upper (front) portion of the top cuff 102. In some cases, the knuckle bracket 106 may be positioned (i) along the lower (front) portion of the top cuff 102 and (ii) below or under the upper (front) portion of the top cuff 102.

Fasteners

In some embodiments, the golf bag may comprise one or more fasteners for securing the lining, a separate front liner piece, and/or the one or more body panels to the top cuff. In some cases, the one or more fasteners may be attached to or integrated with a portion of the top cuff. In some cases, the one or more fasteners may be attached to or integrated with the lining, the separate front liner piece, and/or the one or more body panels.

In some embodiments, the golf bag may comprise one or more tabs for securing the lining, the separate front liner piece, and/or the one or more body panels to the top cuff. In some cases, the one or more tabs may be attached to or integrated with the lining, the separate front liner piece, and/or the one or more body panels.

In some embodiments, a combination of fasteners (e.g., Velcro) and tabs (e.g., PE tabs) may be used to secure the lining, the separate front liner piece, and/or the one or more body panels to each other and/or to the top cuff. In some cases, the fasteners and/or the tabs may be attached to or integrated with (i) the lining, (ii) the separate front liner piece, (iii) the one or more body panels, and/or (iv) a portion of the top cuff (e.g., an inner surface of the top cuff).

Channel Slot

In some embodiments, the top cuff may comprise a channel slot extending along the inner surface of the top cuff. In some cases, the channel slot may extend along an inner surface of the front portion of the top cuff. In some cases, the channel slot may be configured to provide a structural support that the lining or a separate front liner piece can wrap around or over.

In some non-limiting embodiments, the lining may comprise one or more integrated tabs that are insertable into the channel slot to secure the lining to the inner surface of the top cuff. In other non-limiting embodiments, the separate front liner piece may comprise one or more integrated tabs that are insertable into the channel slot to secure the front liner piece to the inner surface of the top cuff. In some alternative embodiments, the one or more body panels may comprise one or more integrated tabs that are insertable into the channel slot to secure the one or more body panels to the inner surface of the top cuff.

As described elsewhere herein, the top cuff of the golf bag may comprise a plurality of dividers extending across the top frame to define a plurality of compartments. In some cases, the plurality of dividers may comprise one or more dividers terminating directly at the inner surface of the top cuff. In some cases, the plurality of dividers may comprise at least one divider terminating at the channel slot disposed along an inner surface of the top cuff. In some cases, the at least one divider terminating at the channel slot may not or need not directly contact the inner surface of the top cuff.

Figure 7:
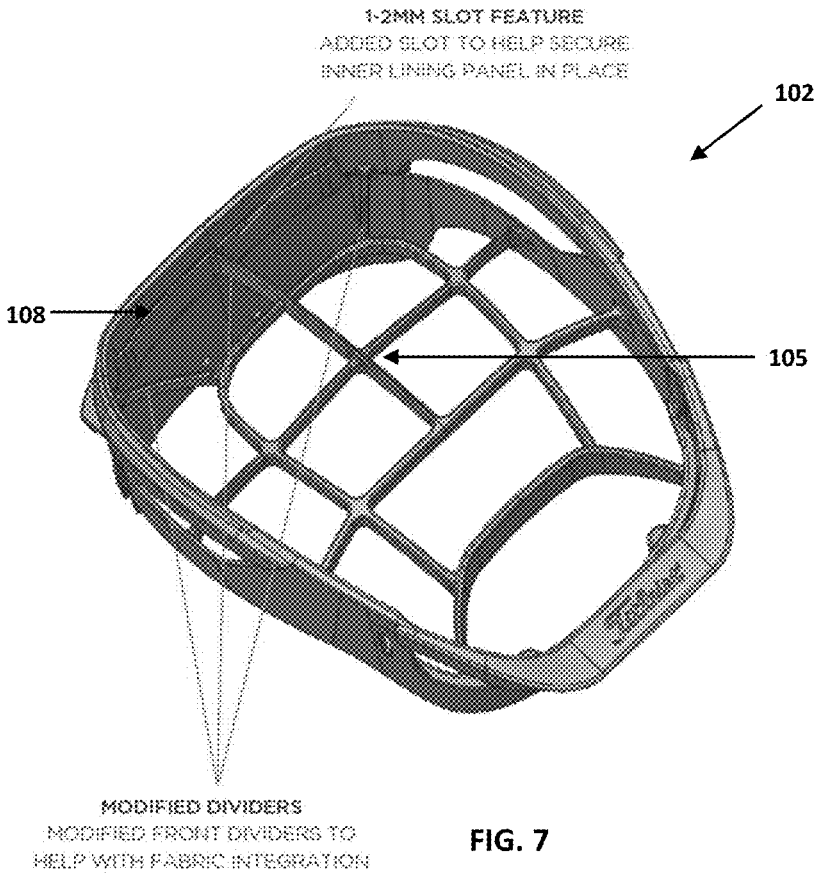
FIGS. 7 and 8 illustrate a channel slot that can be provided along an inner surface of the top cuff, in accordance with some embodiments.
Figure 8:
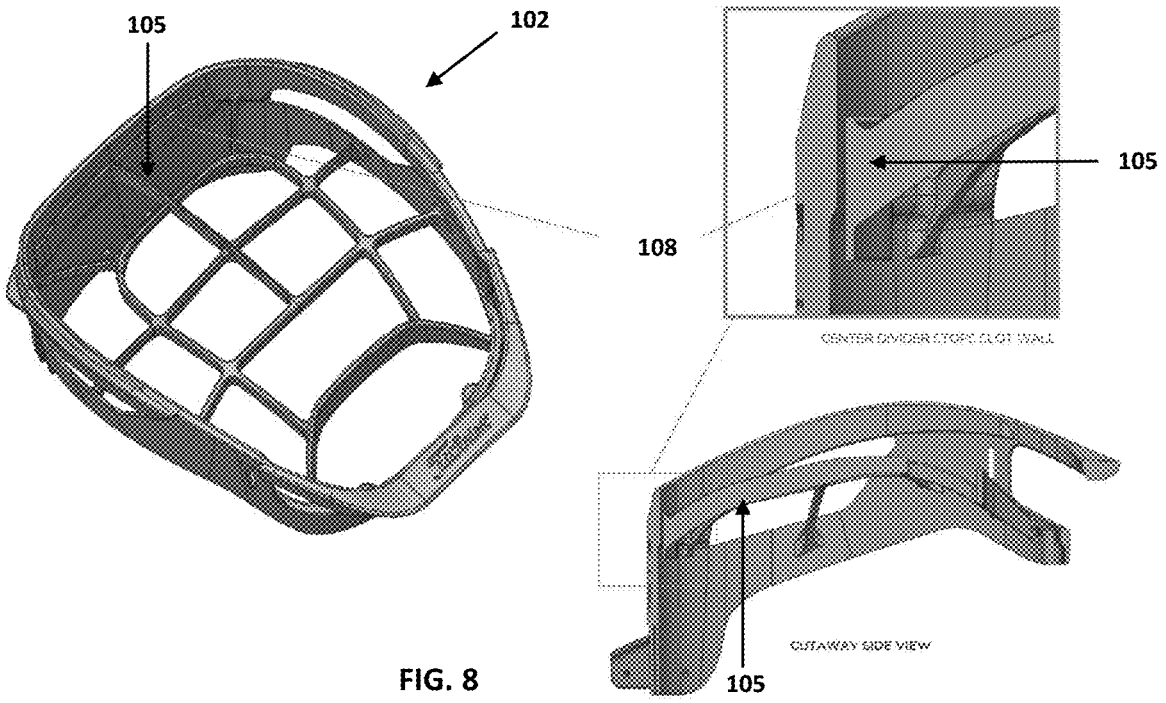

FIGS. 7 and 8 illustrate an example of a top cuff 102 comprising a channel slot 108 for receiving and securing a front liner piece or panel to the top cuff 102. The channel slot 108 may be configured to extend along an inner surface of the top cuff 102. In some cases, the channel slot 108 may have a width ranging from about 1 millimeter (mm) to about 2 millimeters. In some cases, the width of the channel slot 108 may be less than 1 mm. In other cases, the width of the channel slot 108 may be greater than 2 mm. In some cases, the length of the channel slot 108 may correspond to a width of the front liner piece or panel that is inserted into the channel slot 108.

In some embodiments, the top cuff 102 may comprise a plurality of dividers 105 configured to define one or more compartments for housing one or more golf clubs. In some cases, a center divider of the plurality of dividers 105 may be configured to extend from a central region of the top opening to a wall of the channel slot 108. In some cases, the center divider may not or need not directly contact an inner surface or wall of the top cuff 102. In some cases, one or more other dividers of the top cuff 102 may be configured to extend from the central region of the top opening to the inner surface or wall of the top cuff 102. In some cases, the one or more other dividers may be configured to directly contact the inner surface or wall of the top cuff 102.

Figure 9:
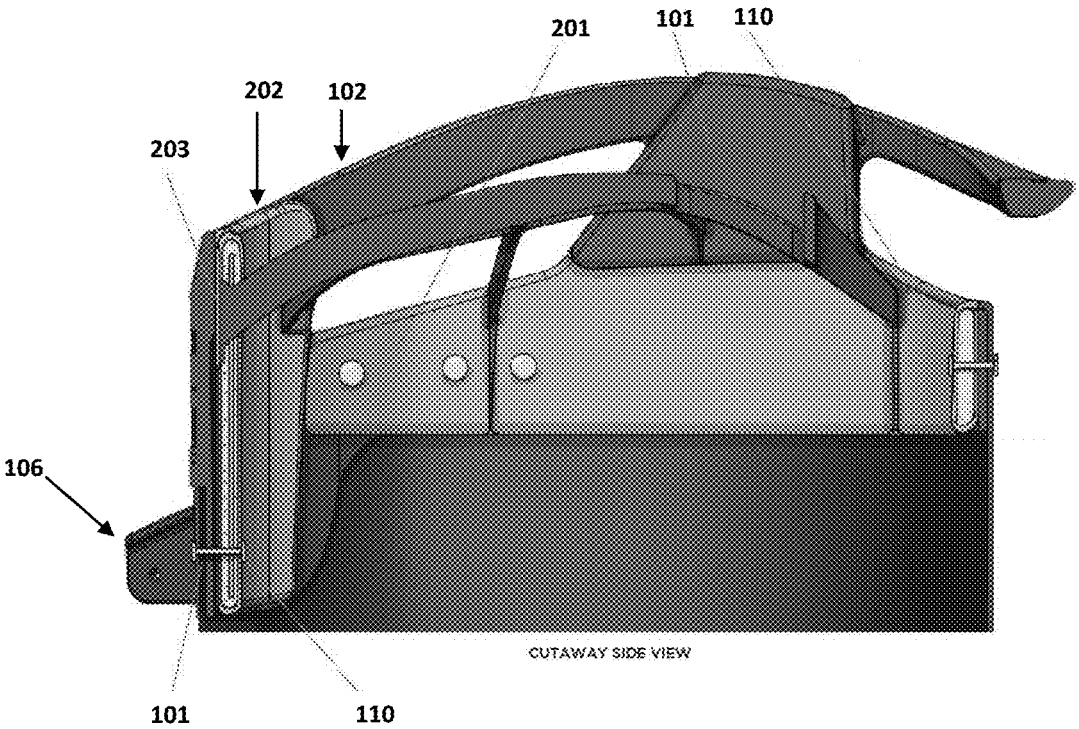
FIGS. 9 and 10 illustrate a cross-sectional view of a golf bag comprising a top cuff wrapped with a lining and one or more body panels, in accordance with some embodiments.
Figure 10:
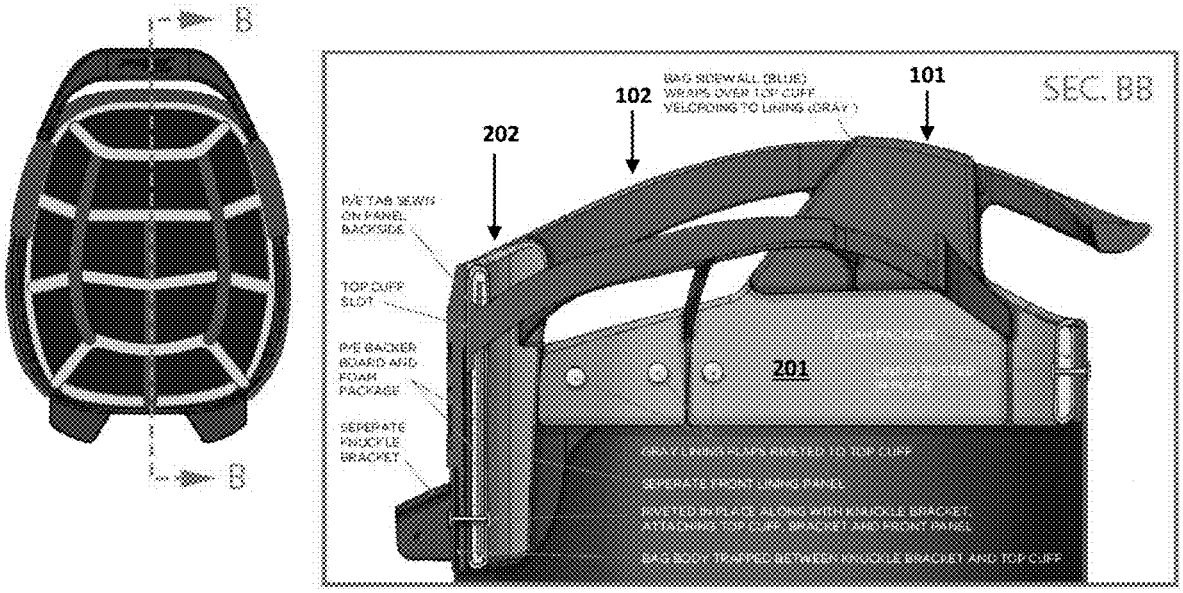

FIGS. 9 and 10 illustrate a cutaway side view of a top cuff 102 with one or more body panels 101 wrapped around or over the top cuff 102. In some cases, the golf bags of the present disclosure may include a lining 201 that wraps around or over the top cuff. The lining may include, for example, a foam material. In some cases, the lining 201 may be fixed in place using one or more fasteners 110 (e.g., one or more rivets). In some embodiments, one or more body panels 101 may wrap around or over the top cuff 102 and attach directly to the lining 201 (e.g., using a fastener or other attachment mechanism). In some cases, the lining 201 and the one or more body panels 101 may wrap around or over a same portion of the top cuff 102. In other cases, the lining 201 and the one or more body panels 101 may wrap around or over different portions or sections of the top cuff 102.

Separate Front Liner Piece

In some embodiments, the golf bag may comprise a front liner piece that is separate from the lining. In some cases, the front liner piece may comprise a support board and/or a foam material.

In some embodiments, the front liner piece may be independently securable around an inner front portion of the top cuff. In some cases, the inner front portion of the top cuff may correspond to the channel slot extending along the inner surface of the top cuff. In some cases, the front liner piece may comprise one or more integrated tabs that are insertable into the channel slot to secure the front liner piece to the inner surface of the top cuff.

In some embodiments, at least one fastener may be used to secure a portion of the front liner piece (e.g., a bottom portion of the front liner piece) to a front portion of the top cuff. In some cases, the same fastener may also secure the knuckle bracket and a front-facing portion of the one or more body panels to the front portion of the top cuff. In some non-limiting embodiments, the at least one fastener may include, for example, one or more rivets.

As shown in FIGS. 9 and 10, in some embodiments, a separate front liner piece 202 can be wrapped around or over an inner front portion of the top cuff 102. In some cases, the inner front portion may correspond to a side or a wall of a channel slot extending along the inner surface of the top cuff. In some cases, the front liner piece 202 may comprise a front lining panel. In some cases, the front lining panel may comprise a polyethylene backer board and a foam material attached to the backer board.

In some cases, the front liner piece 202 may comprise one or more integrated tabs 203. In some cases, the one or more integrated tabs may be attached to a frontside or a backside of the front liner piece 202. The one or more integrated tabs 203 may be inserted into a channel slot provided on an inner surface of the top cuff 102. The integrated tabs 203 may be configured to secure the front liner piece 202 to the top cuff 102.

In some cases, a bottom portion of the front liner piece 202 may be attached to the top cuff using one or more fasteners 110. In some cases, the one or more fasteners 110 may be configured to couple the bottom portion of the front liner piece 202 to the top cuff 102, the knuckle bracket 106, and a portion of the one or more body panels 101 extending around the front of the bag body. In some cases, the same fastener 110 may be used to secure the one or more body panels 101 between the top cuff 102 and the knuckle bracket 106.

Figure 11:
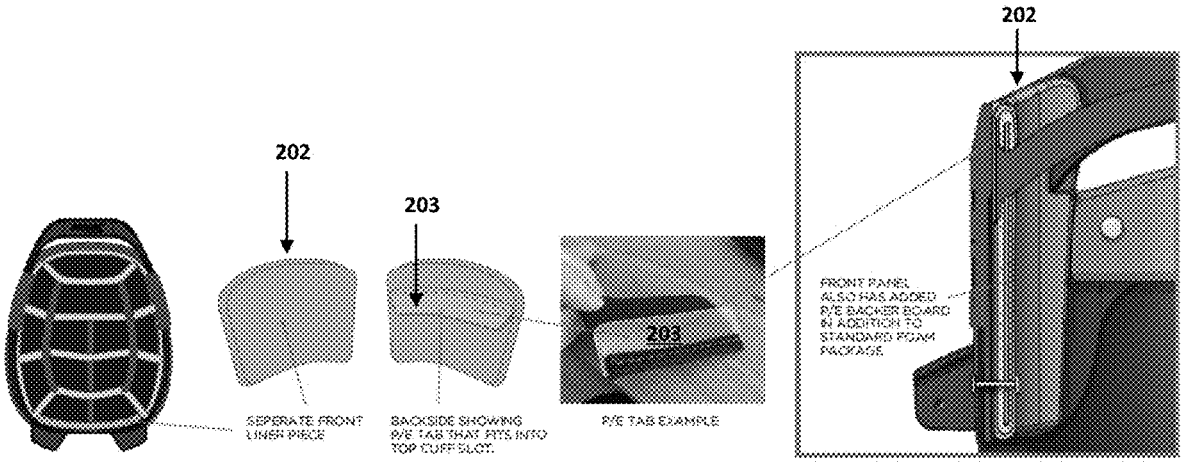
FIG. 11 illustrates an example of a front liner piece or panel that can be provided separately from the lining of the golf bag, in accordance with some embodiments.

FIG. 11 illustrates an example of a separate front liner piece 202 that can be inserted into the channel slot of the top cuff. The front liner piece 202 may be positioned along an interior surface of the front portion of the top cuff. In some cases, the front liner piece 202 may be configured to extend through the channel slot and wrap around or over a portion of the channel slot.

In some cases, the front liner piece 202 may include one or more tabs 203 that are configured to fit into the top cuff slot to secure the front liner piece 202 to the top cuff. In some cases, the one or more tabs 203 may be provided on a backside of the front liner piece 202. The backside of the front liner piece 202 may correspond to a side of the front liner piece 202 that is oriented towards the inner surface of the top cuff. When inserted into the top cuff slot, the one or more tabs 203 may be positioned between the body of the front liner piece 202 and the inner surface of the top cuff.

Figure 12A:
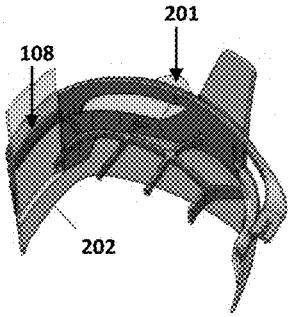
FIGS. 12A-12E illustrate a series of steps for wrapping a top cuff of a golf bag, in accordance with some embodiments.
Figure 12B:
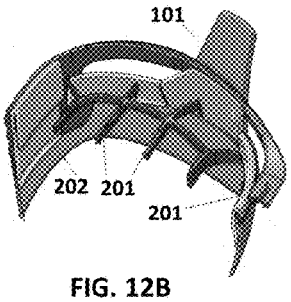
Figure 12C:
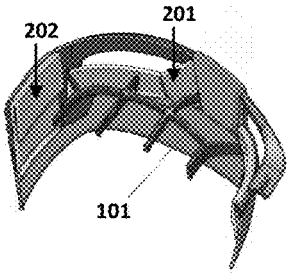
Figure 12D:
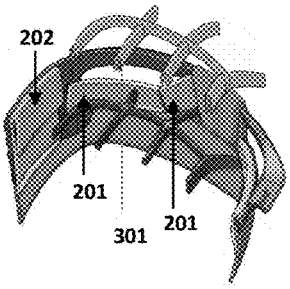
Figure 12E:
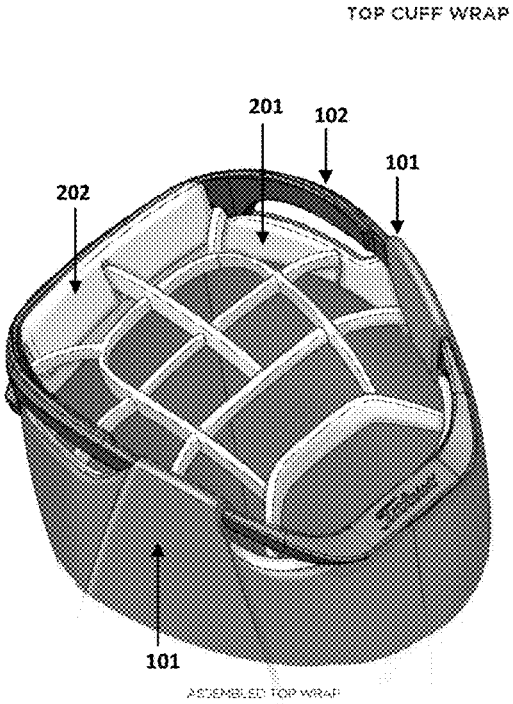

FIGS. 12A-2E schematically illustrate a series of steps for wrapping a top cuff of a golf bag. As shown in FIG. 12A, a front liner piece 202 can be inserted into a channel slot 108 provided on an interior surface of the front portion of the top cuff. As shown in FIG. 12B, the front liner piece 202 can be wrapped over a wall or edge of the channel slot. Additionally, the lining 201 of the golf bag can also be wrapped over various other portions of the top cuff. Further, a flap of the one or more body panels 101 may be wrapped over the top cuff and/or the lining 201. In some cases, the flaps of the body panels may be wrapped over the top cuff and directly secured to a portion of the lining 201 (e.g., as illustrated in FIG. 12C). Afterwards, a divider wrap 301 may be placed over the plurality of dividers (e.g., as shown in FIG. 12D). One non-limiting example of a golf bag with a wrapped top cuff 102 is shown in FIG. 12E. One or more portions or sections of the top cuff 102 may be wrapped or covered by the one or more body panels 101, the lining 201, and the separate front liner piece 202. As discussed above, the separate front liner piece 202 may be wrapped around an inner wall or edge of a channel slot that is provided along an inner surface of the top cuff 102. In some embodiments, the wrapped top cuff 102 may have one or more exposed sections on the front portion(s), the side portion(s), and/or the rear portion(s) of the top cuff. In some cases, the lining 201 and the body panels 101 may be wrapped over a same portion of the top cuff. In some cases, the separate front liner piece 202 may be wrapped over a different portion of the top cuff than the body panels 101 and/or the lining 201.

Velcro Attachment

In some cases, the front liner piece may be configured to wrap over onto itself, and a first portion of the front liner piece may be attachable to a second portion of the front liner piece. In some cases, the first and second portions of the front liner piece can be attached using a hook and loop fastener (e.g., Velcro).

Figure 13:
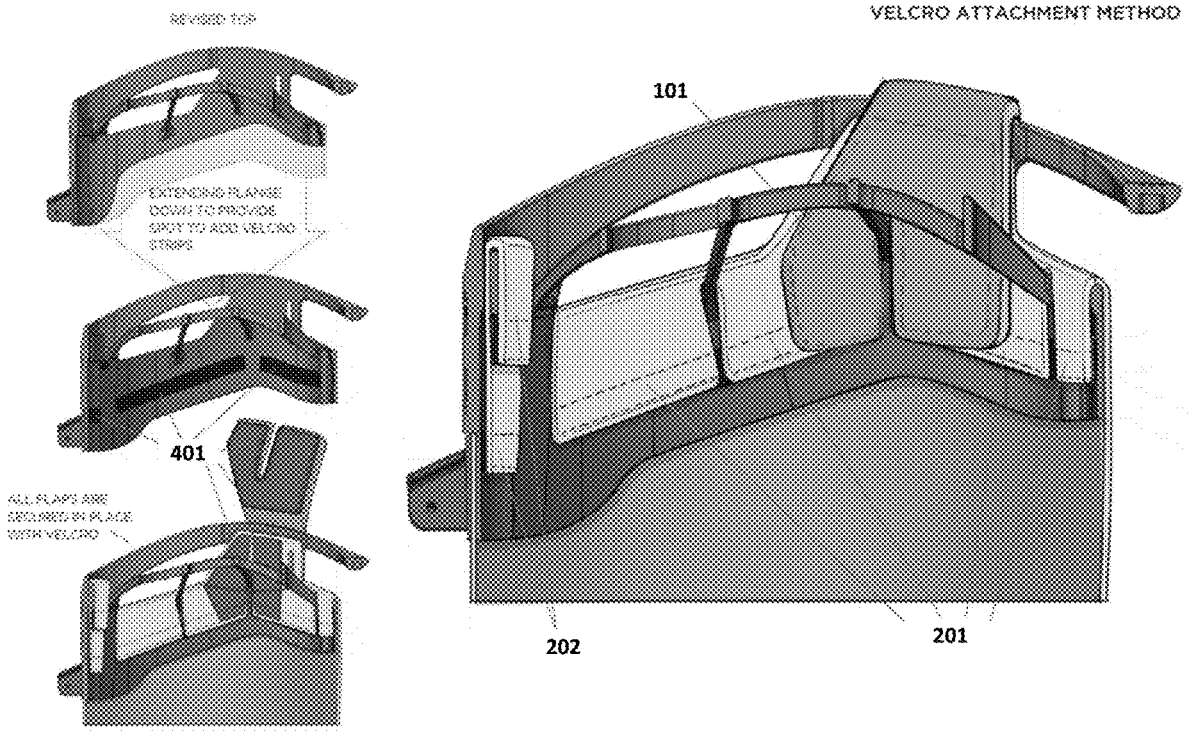
FIG. 13 illustrates a Velcro attachment method for affixing the body panels and/or the lining or front liner piece of the golf bag to the top cuff, in accordance with some embodiments.

FIG. 13 illustrates an example of a top cuff that can be wrapped with a panel or lining that is securable to the top cuff using one or more hook or loop fasteners 401 (e.g., Velcro). In some embodiments, a front portion of the top cuff can extend downwards to provide an inner surface along which the one or more hook or loop fasteners 401 can be provided or attached.

In some cases, a lining 201 of the golf bag may be configured to wrap around the back and/or side portions or edges of the top cuff. In some cases, the lining 201 may be attached to the inner surface of the top cuff using the one or more hook or loop fasteners 401. In some cases, the lining 201 may comprise one or more corresponding loop or hook fasteners that are configured to engage with the hook or loop fasteners 401 attached to the inner surface of the top cuff.

In some cases, a separate front liner piece 202 can extend through a channel slot provided along an inner surface of the top cuff. In some cases, the front liner piece 202 may comprise a panel that can wrap over or onto itself. In some cases, a first portion of the front liner piece 202 can be connected or attached to a second portion of the front liner piece 202 (e.g., using one or more hook and loop fasteners 401) after the front liner piece 202 is wrapped over or onto itself.

In some cases, one or more body panels 101 of the golf bag may be configured to wrap over the top cuff. In some cases, the one or more body panels 101 may comprise a loop or hook fastener that is configured to attach or couple the body panels 101 directly to the lining 201. In some cases, the lining 201 may comprise a material that can engage with the loop or hook fastener provided on the flaps of the body panels 101. In other cases, corresponding hook or loop fasteners can be provided on a surface of the lining 201 to which the body panels 101 are configured to directly attach or couple.

Tab and Slot Attachment

In some cases, the front liner piece, the lining, and/or the one or more body panels may comprise one or more integrated tabs. In some cases, the one or more integrated tabs may interface with a channel slot extending along an inner surface of the top cuff in order to secure the front liner piece, the lining, and/or the one or more body panels to a portion of the top cuff.

In some cases, the front liner piece, the lining, and/or the one or more body panels may be inserted into and wrapped around the channel slot extending along an inner surface of the top cuff. In some cases, one or more integrated tabs of the front liner piece, the lining, and/or the one or more body panels may be insertable into the channel slot from a bottom of the channel slot. In some cases, the integrated tabs may be configured to extend upwards into the channel slot from the bottom of the channel slot to secure the front liner piece, the lining, and/or the one or more body panels to the top cuff.

Figure 14:
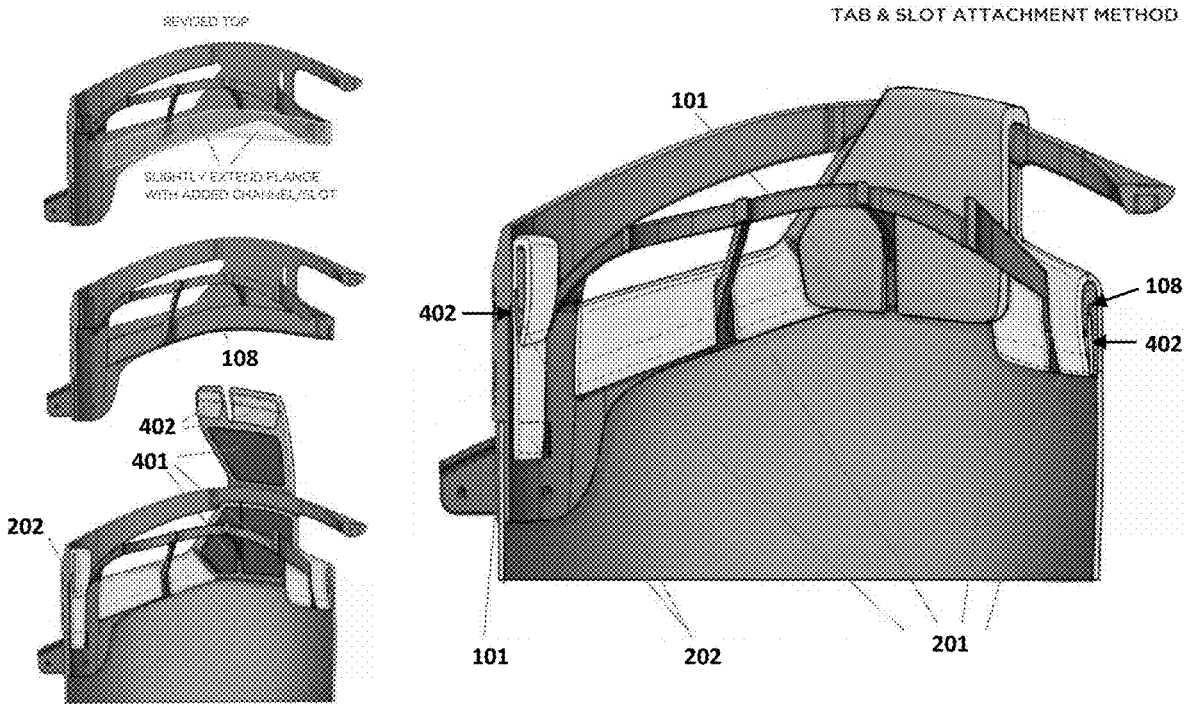
FIG. 14 illustrates a tab and slot attachment method for affixing the body panels and/or the lining or front liner piece of the golf bag to the top cuff, in accordance with some embodiments.

FIG. 14 illustrates an example of a top cuff that can be wrapped with a panel or lining that is secured using one or more slots and one or more tabs. In some embodiments, a portion of the inner surface of the top cuff can extend downwards to accommodate a channel slot 108 that extends along the inner surface of the top cuff.

In some cases, a lining 201 may be configured to wrap over or around the back and/or the side portions or edges of the top cuff. In some cases, the lining 201 may comprise one or more integrated tabs 402 that are insertable into the channel slot 108 from the bottom opening of the channel slot 108. The integrated tabs 402 may be configured to fix the lining 201 to the top cuff.

In some embodiments, a separate front liner piece 202 can be configured to extend through the channel slot 108 and wrap around or over a wall or an edge of the channel slot 108. In some cases, the front liner piece 202 may include one or more integrated tabs 402 that are insertable into the channel slot 108 from the bottom opening of the channel slot 108. The one or more integrated tabs 402 may be configured to fix the front liner piece 202 to the channel slot 108 formed along the inner surface of the top cuff.

In some embodiments, one or more bag body panels 101 can be configured to wrap over or around the top cuff. In some embodiments, the body panels 101 can be directly affixed to a portion of the lining 201 that is attached to the inner surface of the top cuff (e.g., using one or more hook and loop fasteners 401). In some embodiments, the body panels 101 may further comprise one or more integrated tabs that can be inserted into the bottom opening of the channel slot 108 to secure the body panels 101 to the channel slot 108 and/or the top cuff.

All patents, publications, and references cited herein, including priority documents, are fully incorporated by reference. The materials, designs, constructions, structures, assemblies, sub-assemblies, and components described herein represent only some of the exemplary embodiments contemplated by the present disclosure. It is appreciated by those skilled in the art that variations can be made without departing from the spirit and scope of the present disclosure. Exemplary embodiments of the present disclosure are covered in the following claims.

What is claimed is:

1. A golf bag, comprising:

a body comprising an opening, a closed bottom, and one or more body panels;

a top cuff attached to the opening, the top cuff comprising (i) a first member extending along one or more sides of the top cuff, (ii) a second member extending above the first member, the second member forming an uppermost part of the top cuff, and (iii) an aperture or a window provided between the first member and the second member; and a lining configured to extend through the aperture or the window and over the first member of the top cuff, wherein the lining is secured to an inner surface of the top cuff, wherein the one or more body panels are configured to extend upwards along an outer surface of the top cuff, over the uppermost part of the top cuff, and back downwards along the inner surface of the top cuff.

2. The golf bag of claim 1, wherein the one or more body panels are releasably coupled to the lining.

3. The golf bag of claim 1, wherein the one or more body panels are configured to overlap the lining.

4. The golf bag of claim 1, wherein the one or more body panels comprise at least one panel that extends continuously from the closed bottom to the second member of the top cuff.

5. The golf bag of claim 1, wherein the one or more body panels and the lining extend over or around a same portion or section of the top cuff.

6. The golf bag of claim 1, wherein the top cuff comprises an exposed front panel configured to contact or interface with a bag holding mechanism, wherein the one or more body panels do not cover or overlap the exposed front panel.

7. The golf bag of claim 1, further comprising a knuckle bracket configured to interface with one or more legs of the golf bag.

8. The golf bag of claim 1, further comprising a front liner piece that is separate from the lining and independently securable to the top cuff.

9. The golf bag of claim 8, wherein the front liner piece comprises a support board and a foam material configured to provide a protective layer for the top cuff and one or more golf clubs placed in the golf bag.

10. The golf bag of claim 8, wherein the front liner piece does not cover or overlap an exposed front panel of the top cuff.

11. The golf bag of claim 10, wherein the front liner piece is configured to extend along a back side of the exposed front panel.

12. The golf bag of claim 8, wherein the top cuff comprises an inner wall that is spaced apart from the inner surface to form a channel slot, wherein the channel slot is configured to secure the front liner piece along a front portion of the inner surface of the top cuff.

13. The golf bag of claim 12, wherein the front liner piece is configured to extend over an upper edge of the inner wall and through a bottom of the channel slot.

14. The golf bag of claim 1, wherein the top cuff comprises one or more dividers extending directly to or from the inner surface of the top cuff.

15. The golf bag of claim 14, wherein the top cuff comprises at least one divider that does not extend directly to or from the inner surface of the top cuff.

16. The golf bag of claim 1, wherein the one or more body panels are configured to extend around and over the first member and the second member.

17. The golf bag of claim 1, wherein a portion or a section of the one or more body panels is configured to extend through the aperture or the window.

18. The golf bag of claim 1, wherein the one or more body panels and the lining are secured to different portions of the inner surface of the top cuff.

19. The golf bag of claim 1, wherein a portion or a section of the one or more body panels is directly attached or coupled to the inner surface of the top cuff.

20. The golf bag of claim 1, wherein a first portion of the one or more body panels is directly coupled to the inner surface of the top cuff and a second portion of the one or more body panels is indirectly coupled to the inner surface of the top cuff.

* * * * *